US009273926B2

(12) United States Patent
Wood et al.

(10) Patent No.: US 9,273,926 B2
(45) Date of Patent: Mar. 1, 2016

(54) CONVERSION KIT WITH A RAIL SYSTEM FOR A PAINTBALL MARKER

(71) Applicant: Planet Eclipse Limited, Trafford Park, Manchester (GB)

(72) Inventors: Jack Kingsley Wood, Chelford (GB); Matthew Harry Mahoney, Manchester (GB)

(73) Assignee: PLANET ECLIPSE LIMITED, Manchester (GB)

( * ) Notice: Subject to any disclaimer, the term of this patent is extended or adjusted under 35 U.S.C. 154(b) by 0 days.

(21) Appl. No.: 13/775,414

(22) Filed: Feb. 25, 2013

(65) Prior Publication Data

US 2013/0220295 A1 Aug. 29, 2013

Related U.S. Application Data

(60) Provisional application No. 61/603,830, filed on Feb. 27, 2012.

(51) Int. Cl.

| | |
|---|---|
| ***F41B 11/00*** | (2013.01) |
| ***F41B 11/89*** | (2013.01) |
| ***F41C 23/12*** | (2006.01) |
| ***F41B 11/70*** | (2013.01) |
| ***F41G 11/00*** | (2006.01) |
| ***F41A 3/66*** | (2006.01) |

(Continued)

(52) U.S. Cl.

CPC . *F41B 11/70* (2013.01); *F41A 3/66* (2013.01); *F41B 11/00* (2013.01); *F41B 11/62* (2013.01); *F41B 11/89* (2013.01); *F41C 23/12* (2013.01); *F41C 23/16* (2013.01); *F41C 23/20* (2013.01); *F41G 11/003* (2013.01)

(58) Field of Classification Search

CPC ..... F41B 11/00; F41B 11/60; F41B 11/62; F41B 11/70; F41B 11/89; F42B 6/00; F41C 23/12; F41C 23/16; F41C 23/20; F41G 11/003; F41G 11/004; F41A 3/66

USPC ..... 124/1, 80, 84, 73

See application file for complete search history.

(56) References Cited

U.S. PATENT DOCUMENTS 3,512,290 A * 5/1970 La Violette, Jr. et al. .... 42/75.01
3,611,607 A * 10/1971 Donnell ..... 42/106

(Continued)

FOREIGN PATENT DOCUMENTS

| | | |
|---|---|---|
| CA | 2631979 A1 | 11/2009 |
| DE | 102004014734 B3 | 9/2005 |
| EP | 2314976 A2 | 4/2011 |

*Primary Examiner* — John E Simms, Jr.

(74) *Attorney, Agent, or Firm* — Barlow, Josephs & Holmes, Ltd.

(57) ABSTRACT

A convertible projectile launching device includes a projectile launching device, such as a paint ball marker, a less than lethal launcher or an airsoft gun, to which a user can secure at least one shell that changes the outer configuration or appearance of a projectile launching device on which it is secured into a MILSIM style projectile launching device. Any type of fasteners may be used to secure the shells to the device. The surface of at least one shell provides a rail system for mounting objects to the projectile launching device. The shell has a mating surface that engages a corresponding mating surface on the projectile launching device in order to increase stability of the shell. A blanking plug or a butt stock can be inserted into the rear of the shell, secured by a latch or other mechanism on at least one shell.

43 Claims, 11 Drawing Sheets

(51) Int. Cl.

| | |
|---|---|
| ***F41C 23/16*** | (2006.01) |
| ***F41C 23/20*** | (2006.01) |
| ***F41B 11/62*** | (2013.01) |

(56) References Cited

U.S. PATENT DOCUMENTS

| | | | | |
|---|---|---|---|---|
| 3,685,194 | A * | 8/1972 | Coon | 42/77 |
| 3,798,819 | A * | 3/1974 | Hillberg | 42/72 |
| 4,601,123 | A * | 7/1986 | Swearengen et al. | 42/72 |
| 5,555,661 | A * | 9/1996 | Yap | 42/49.02 |
| 6,655,069 | B2 * | 12/2003 | Kim | 42/114 |
| 8,205,373 | B1 * | 6/2012 | Ubl et al. | 42/71.01 |
| 8,713,838 | B2 * | 5/2014 | Ubl et al. | 42/71.01 |
| 2005/0241211 | A1 * | 11/2005 | Swan | 42/124 |
| 2008/0168973 | A1 * | 7/2008 | Levin et al. | 124/73 |
| 2009/0282718 | A1 * | 11/2009 | Bartley | 42/75.03 |
| 2011/0283582 | A1 | 11/2011 | Hunter et al. | |
| 2012/0042557 | A1 * | 2/2012 | Gomez et al. | 42/90 |

* cited by examiner

CONVERSION KIT WITH A RAIL SYSTEM FOR A PAINTBALL MARKER

CROSS REFERENCE TO RELATED APPLICATION

This application is related to and claims priority from earlier filed provisional patent application Ser. No. 61/603,830, filed Feb. 27, 2012, the entire contents thereof is incorporated herein by reference.

BACKGROUND OF THE INVENTION

The invention relates generally to paintball markers and air soft guns and the gameplay related thereto. The sport of paintball is very well known and includes the use of a paintball marker or gun to pneumatically launch a rubber ball or a ball that is typically filled with a colored liquid. For air soft, plastic projectiles are shot at opposing players or targets. Each of the players in the game has such a marker or gun so they can launch projectiles toward players on the opposing team. When players on the opposing team are marked or hit with a projectile, there is typically a scoring event.

The present invention is particularly related to the game of paintball and the related paintball markers. Therefore, the invention will be discussed in detail in connection with paintball markers for ease of illustration but it should be understood that the present invention is applicable to the air soft sport and air soft guns as well.

Also, the present invention relates to any type of projectile launching device or any device that is or simulates a projectile launching device, such as a laser tag simulated firearm. The present invention has applicability for use in security and police forces as well as "less than lethal" and "non-lethal" firearms. For ease of discussion herein, the present invention is discussed in detail in connection with paintball markers but is should be understood that the present invention can be used in connection with any type of firearm, projectile launcher and simulated versions thereof.

It is known, in the sport of paintball, that there are many different types of game play. For example, "supair or speedball": events are very close range games, played on a small field, using inflatable bunkers or similar small barricades. Typically they last a few minutes and the turnaround between games is limited to a few minutes or seconds. Such speedball games can even be played indoors. In speedball events it is preferable to have a small low profile paintball marker that is hard for a player's opponent to see and shoot at, but is quick and easy to clean the paint from between games if the player is shot during the game. Thus, for this type of game, the basic or core paintball marker is all that is needed.

On the other hand, another popular type of paintball gameplay is called a "scenario or MILSIM (military simulation)" game. Such a scenario game is played on a much larger mixed terrain field, possibly woodland or urban environment, the idea of the game is to mimic some sort of "war type scenario." Typically these games are played over a much longer period of time, normally hours or days. In scenario games many people find it preferable to have a paintball marker that you can attach various third party devices or tactical aids to, such as a fore grip, magazine, sling mounts, light sources/torches, optical sights, laser sights, cameras etc. In other words, in these types of scenario types games, it is desirable for the paintball marker to look and have the ability to accessorize more like a real firearm, such as an M16 or M4, therefore creating a MILSIM (military simulation) marker or airsoft gun.

There is a need in the prior art to enable a paintball marker (or air soft gun) to be easily and quickly converted over from its basic speedball form to a scenario or MILSIM form that includes some type of rail arrangement/system so it can more closely simulate a real firearm. As is well known, accessories, such as a light sources and scopes, are commonly mounted onto rail systems.

There have been attempts in the prior art to provide rail systems on guns and replacement mounting systems that can be interchanged on these guns. However, these devices and systems are inadequate because they do not closely simulate a real weapon or firearm because they do not completely enshroud the marker or gun. Without full or substantially full enshroudment of the underlying projectile launching device, attachment of accessories simulating a real weapon or firearm is not possible.

These prior art systems are also inadequate because they do not completely detach to leave a marker that is totally free from any rail mountings. There are shrouds or mounting systems available, but they typically attach to the barrel or to the existing rail mount.

There is a need to provide a rail kit for a paintball marker or an air soft gun that can also simultaneously easily convert the marker from a normal non-MILSIM setup to a modified scenario MILSIM set up that more closely simulates a real firearm. There is a need to provide a rail kit for a paintball marker or an air soft gun that is easy to install, remove and clean, and allows easy access to the eyes or ball detectors, without the need to remove the rail kit. There is a need to provide a rail kit for a paintball marker or airsoft gun that allows easy access to the internals of the paintball marker, without the need to remove the complete rail kit, by providing an easily removable rear cap or opening to allow removal of the internal firing mechanism for easy maintenance. There is a need to provide a rail kit for a paintball marker or airsoft gun that allows easy fitment of a stock via a quick release mechanism that may be operated with a lever latch mechanism, screw fit, bayonet fit or other mechanism. There is also a need to provide a rail kit for a paintball marker or airsoft gun that has rail mounts or the ability to mount accessory rails, such as Weaver, Picatinny or NATO rails built into the rail kit. There is a need to provide a rail kit for a paintball marker or airsoft gun that does not clamp onto, nor interfere with the barrel of the paintball marker or airsoft gun. Finally, there is a need to provide a rail kit that can receive a wide range of accessories thereon like a rail system of a real firearm.

SUMMARY OF THE INVENTION

The present invention preserves the advantages of prior art paintball markers and airsoft guns accessories added thereto. In addition, it provides new advantages not found in currently available markers, guns and accessories and overcomes many disadvantages of such currently available markers, guns and accessories.

The invention is generally directed to the novel and unique rail kit that is attached to a paintball marker, air soft gun or any other type of projectile launching device or simulated device thereof. The rail kit can quickly and easily convert a standard paintball marker or air soft gun from a conventional speedball non-MILSIM setup to a scenario or MILSIM setup that simulates the look and mounting flexibility of a real firearm. The purpose of the rail kit of the present invention is to allow the user to play 'speedball type games' and "scenario type games" with the same paintball marker by simply adding or removing the rail kit system.

It is therefore an object of the present invention to provide a rail kit for a paintball marker or an air soft gun that can easily convert it from a normal non-MILSIM setup to a modified scenario MILSIM set up that more closely simulates a real firearm.

Another object of the present invention is to provide a rail kit for a paintball marker or an air soft gun that is easy to install, remove and clean.

Another object of the present invention is to provide a rail kit for a paintball marker or airsoft gun that allows easy access to the eyes or ball detectors, without the need to remove the rail kit, by providing easily removable eye cover plates.

Another object of the present invention is to provide a rail kit for a paintball marker or airsoft gun that allows easy access to the internals of the paintball marker, without the need to remove the complete rail kit, by providing an easily removable rear cap or opening to allow removal of the internal firing mechanism, such as for easy maintenance or any other purpose.

Another object of the present invention is to provide a rail kit for a paintball marker or airsoft gun, projectile launcher or simulation thereof that allows easy fitment of a stock via a quick release mechanism that may be operated with a lever latch mechanism or any other type of mechanism.

Another object of the present invention is to provide a rail kit for a paintball marker or airsoft gun that has rail mounts such as Weaver, Picatinny or NATO rails built into the rail kit.

Another object of the present invention is to provide a rail kit for a paintball marker, airsoft gun, projectile launcher or simulation thereof that has the ability to mount accessory rails such as Weaver, Picatinny, NATO rails, dovetail rail or other rail system onto the rail kit.

Another object of the present invention is to provide a rail kit for a paintball marker or airsoft gun that does not clamp onto, nor interfere with the barrel of the paintball marker or airsoft gun. Therefore allowing the barrel to be removed without the need to remove the complete rail kit. For example, optionally, the regulator, frame, feed neck can be removed where the rail kit does not interfere of clamp onto these components.

A further object of the present invention is to provide a rail kit that can receive a wide range of accessories thereon like a rail system of a real firearm.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

The add-on mounting rail kit 10 is designed to be simple to add or remove from a paintball marker 11, thus enabling the player to enjoy all types of paintball games with the same paintball marker 11. This negates the need for the player to have to buy two guns to play all types of the game, saving the player a great deal of money.

Figure 1:
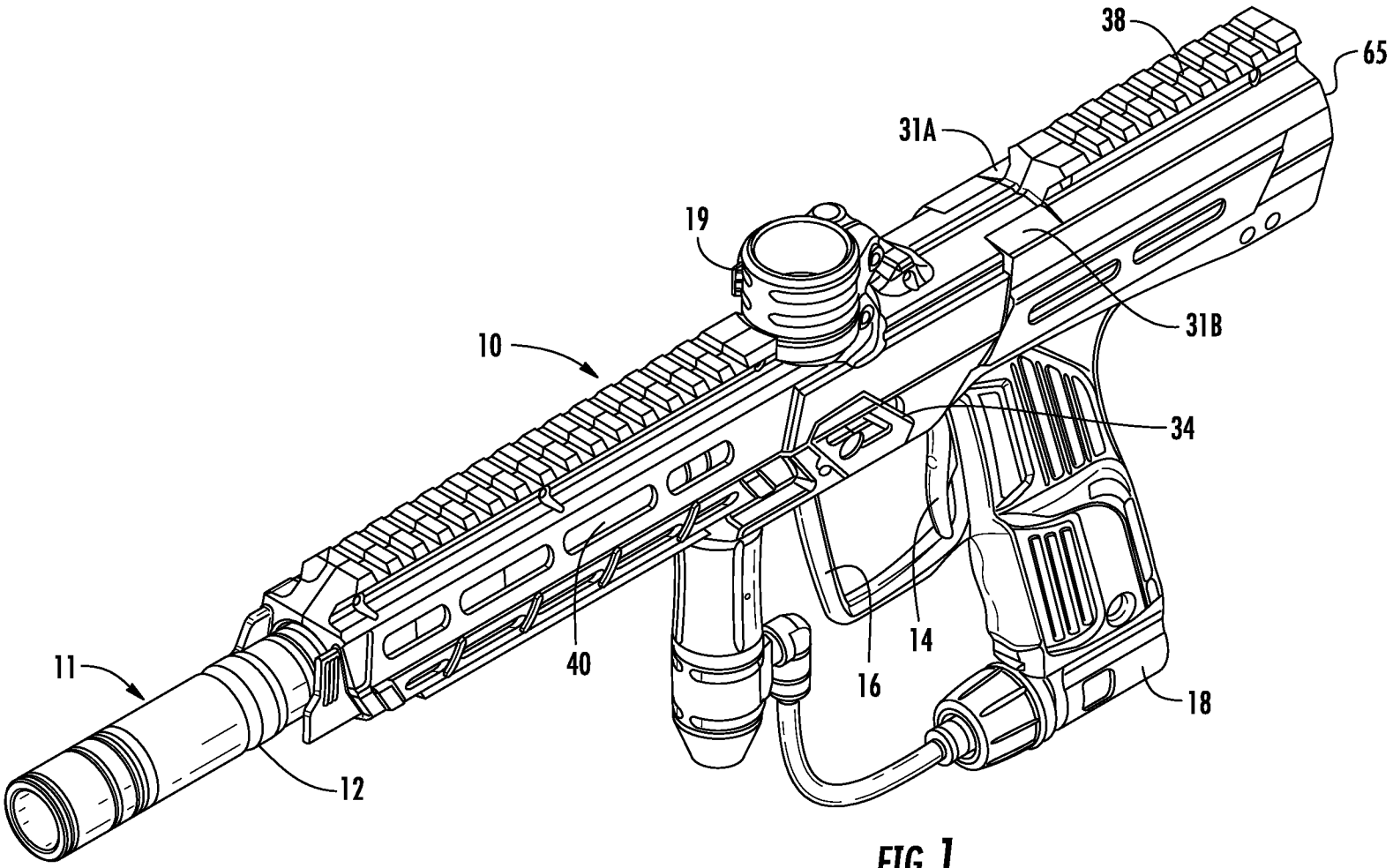
FIG. 1 is a perspective view of the rail kit of the present invention installed on a standard paintball marker.
Figure 2:
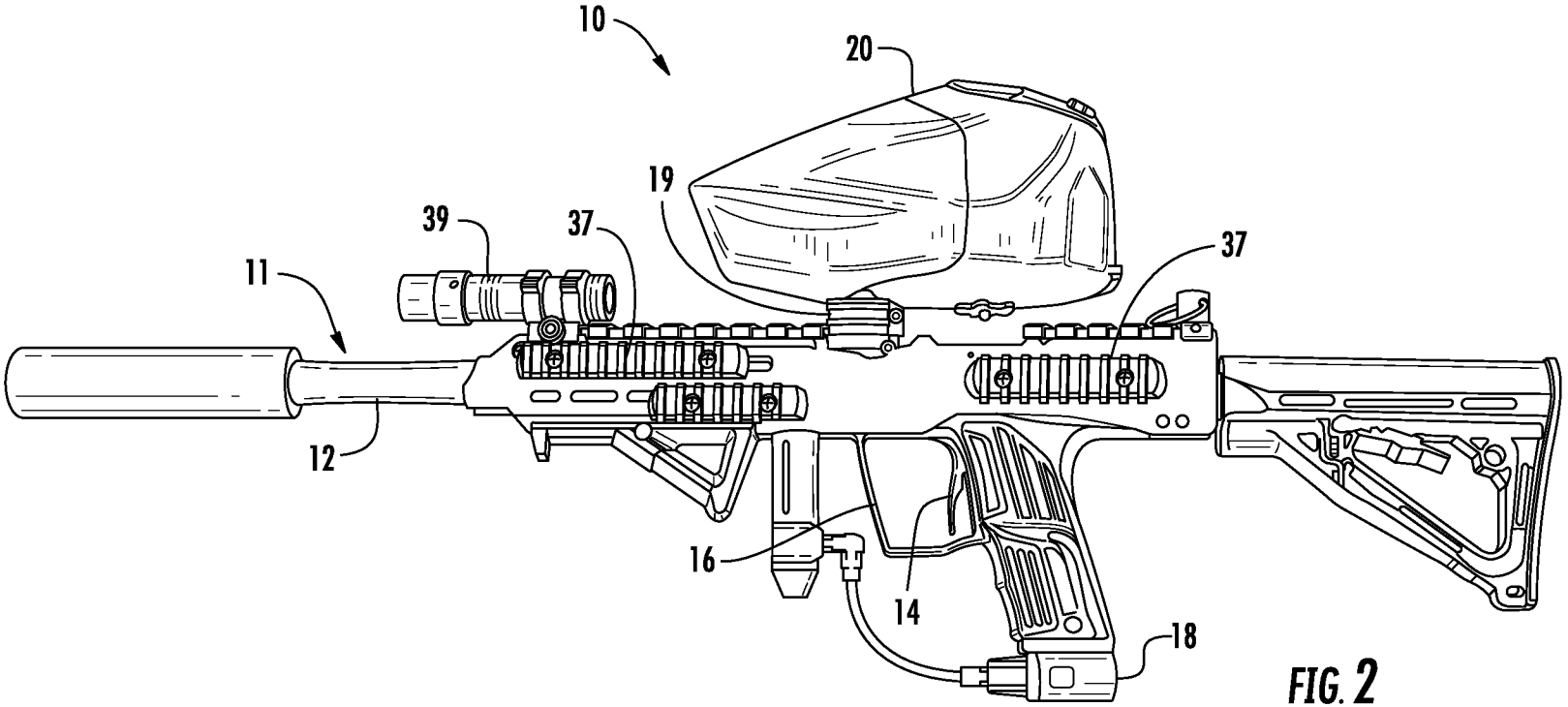
FIG. 2 is a side elevational view of a marker equipped with the rail kit of the present invention with some accessories installed on the rail system.
Figure 3:
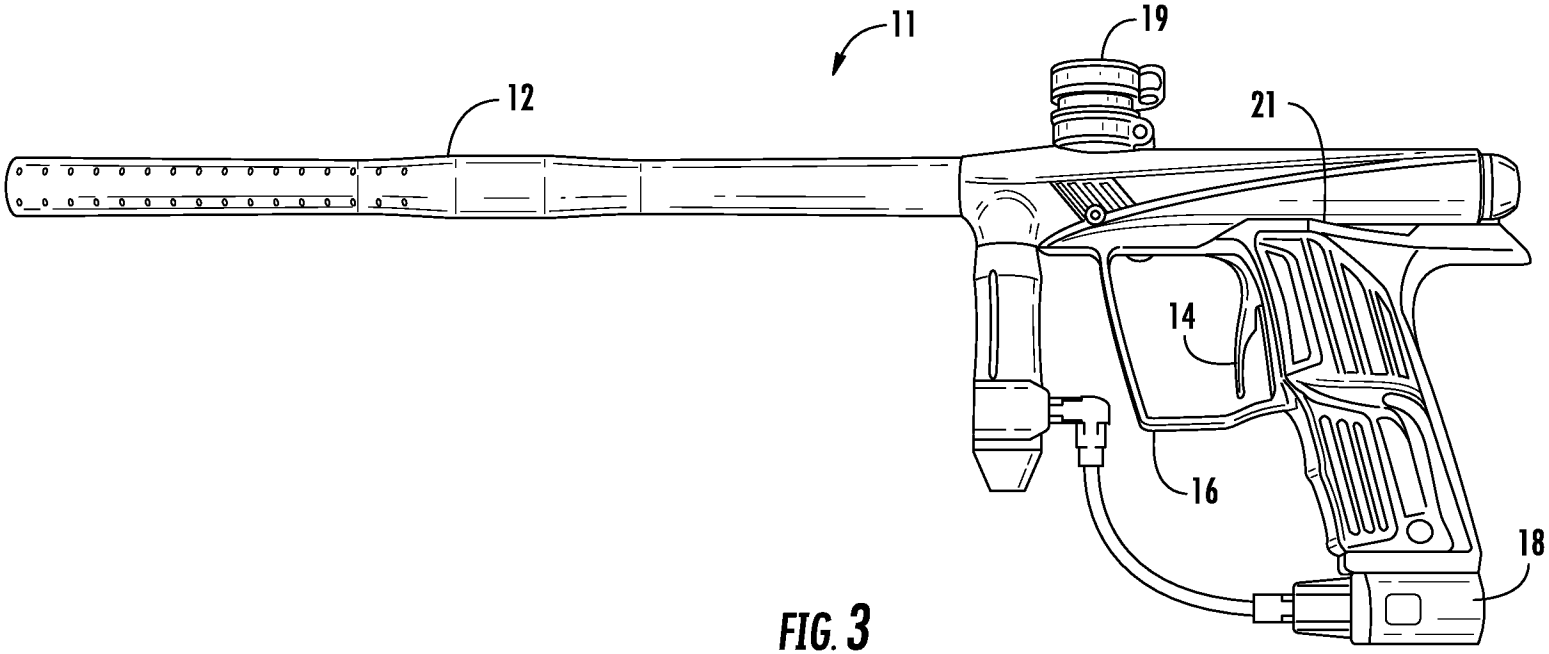
FIG. 3 is a standard type paintball marker, without the rail kit of the present invention installed, that could be used in speedball non-MILSIM type paintball games.
Figure 4:
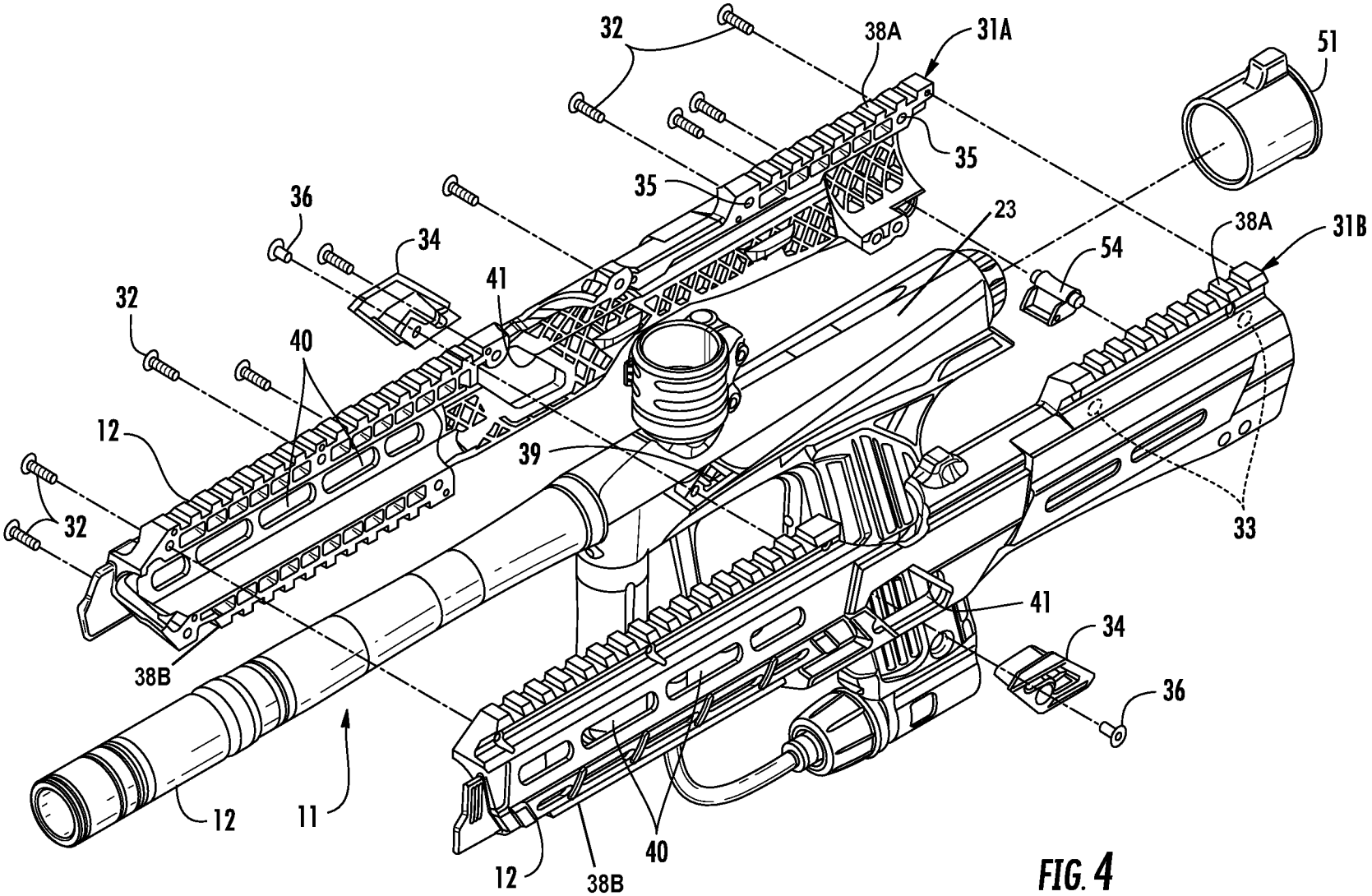
FIG. 4 is an exploded perspective view of the paintball marker of FIG. 3 with the rail kit of the present invention shown enshrouded thereabout in exploded fashion along with a blanking plug, which is retained in place by a lever latch lock system.

The construction of the rail kit 10 of the present invention can be seen best in connection with FIGS. 1, 2 and 4. The uniqueness of the present invention is directed to the rail kit 10 providing a substantially full shroud about the underlying marker 11 (such as seen in FIG. 3) to convert it's exterior configuration to a scenario MILSIM type marker, as seen in FIGS. 1 and 2.

An example of an underlying marker 11 is shown in FIG. 3. The marker 11 has a barrel end 12 and a handgrip end 16. The handgrip end 16 has a trigger 14 and a gas tube receiver 18 for receiving compressed gas from a tank (not shown) to operate the paintball marker 11. The marker 11 also has notches 21 on the outer surface of the marker 11 and contact points 23 on the upper surface of the marker 11. These notches 21 and contact points 23 help secure mounting of the conversion kit 10 of the present invention. On the upper surface of the marker 11 is a paintball receiver 19 capable of engaging a paintball hopper 20, as seen in FIG. 2. Other hoppers, magazines and paintball feeding mechanisms could be mounted on or under the conversion kit 10 in order to provide paintballs to the marker, in accordance with the present invention.

FIG. 1 shows the conversion kit 10 of the present invention enshrouding or covering the underlying marker 11 while still allowing the user to access and inspect features, parts and components of the marker 11, such as the trigger 14, the gas tube receiver 18, the paintball receiver 19, and the barrel 12 without removing the conversion kit 10 from the marker. Thus, even when the conversion kit 10 is installed on the marker 11, the operation of the underlying marker 11 remains unaffected and the marker 11 operates in a normal fashion.

The conversion kit 10, shown in FIG. 1, preferably has two shells 31A, 31B that are secured on the marker 11. While two shells are preferred, it is envisioned that the conversion kit 10 may include more than two shells, such as where multiple shells are secured about each side of the marker 11. These variations in the configuration of the shells are considered to be within the scope of the present invention.

Referring to FIG. 4, for example, the shells have apertures 40 through the sides of the shells 31A, 31B and a rail system 38A formed on the upper surfaces of the shells and rail system 38B on the lower surface of the shells 31A and 31B. It should be noted that the tops of the shells 31A and 31B are show to respectively provide a partial rail system. When the shells 31A and 31B are mated together, as in FIG. 1, they form, together, a full rail system of a desirable width. It is also possible that the rail system is provided on only one of the shells. It is also possible that the rail system is provided on any surface of the shells. Further apertures 41 are also preferably provided to receive eye covers 34, which are secured by fasteners 36. This enables access to important components on the marker 11.

FIG. 2 also shows that additional side rails 37 may be mounted on the apertures of the conversion kit. These features both give the marker an appearance that is more similar to a real firearm. Furthermore, the rail system 38 and side rails 37 each allow the user to mount objects to the marker with the conversion kit 10. For example, FIG. 2 shows a light 39 that is mounted to the rail system 38 of the conversion kit 10. A user could also mount other objects, such as a laser sight, an optical sight, a scope, a magazine or other firearm accessories. Although the rail system, collectively 37 and 38, shown in the figures resembles a common rail system design, other rail systems are also possible. Also, although the figures show a rail system 38 on the upper surfaces of the shells and side rails 37, in other embodiments, the rail system may be provided on a lower, or any surface of the shells, such that objects could be mounted directly below or on any surface of the shells 31A, 31B.

FIG. 4 shows the shells 31A, 31B have removable eye cover plates 34 that allow easy access to ball detectors 39, without the need to remove the rail kit 10. As shown in FIG. 1, the eye cover plates 34 are removably fastened to the shells 31A, 31B using cover plate fasteners 36. In FIG. 1, these cover plate fasteners 36 are shown as threaded fasteners, but a person of ordinary skill in the art could use other fastening methods.

Figure 5:
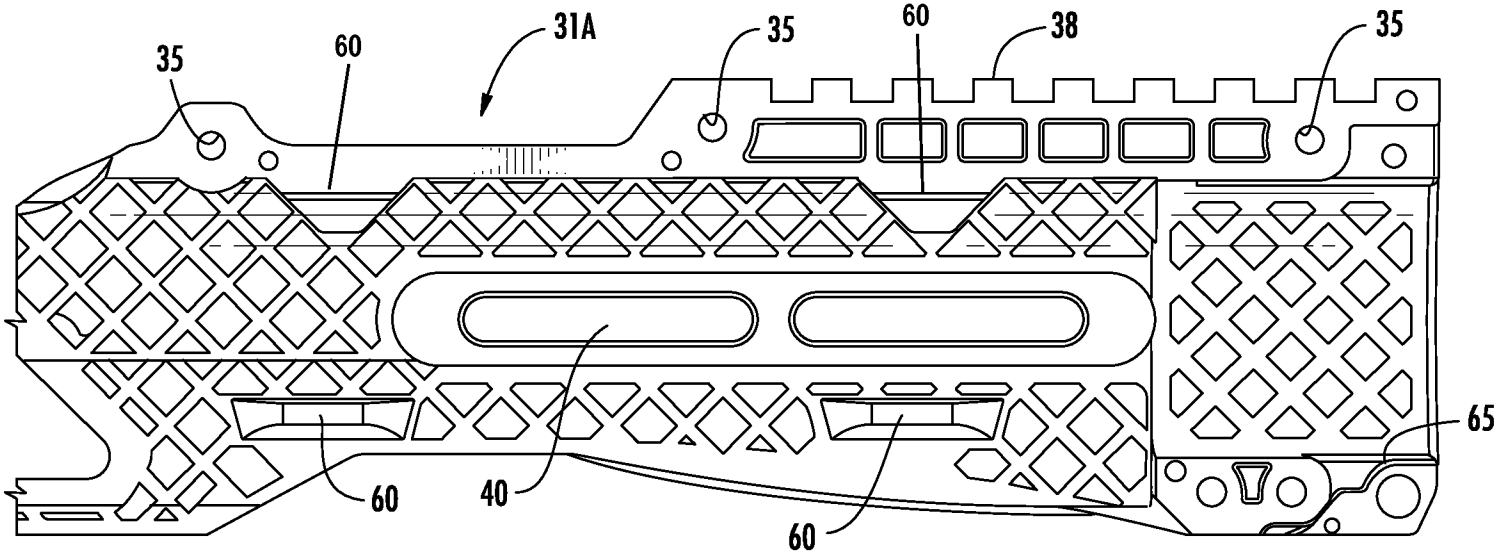
FIG. 5 is one of the half-shells of the rail kit of the present invention showing contact points.
Figure 6:
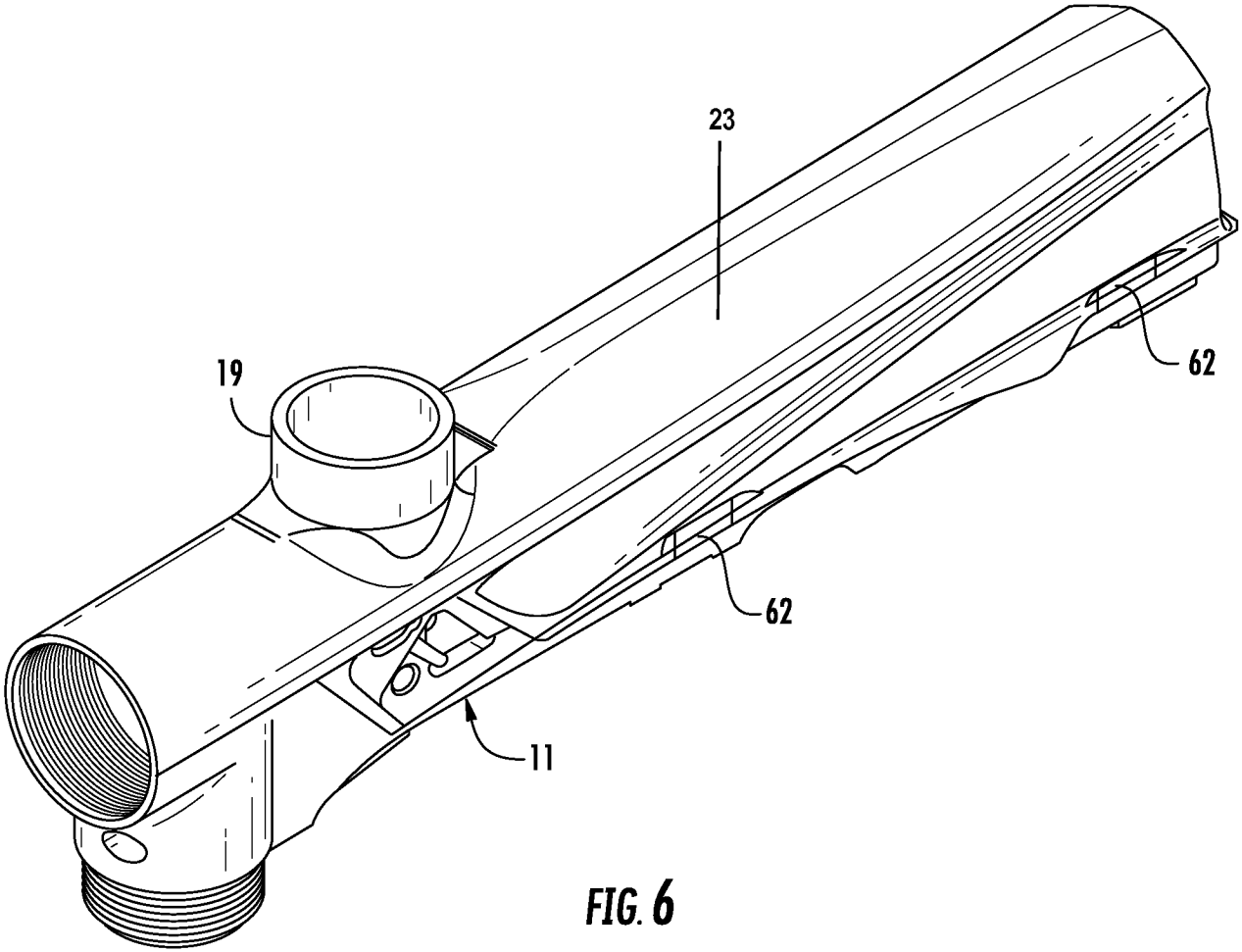
FIG. 6 is a shows contact points between an underlying paintball marker and the shell (as in FIG. 5), when fully assembled, such as shown in FIG. 1.

FIGS. 4-6 show how the shells 31A, 31B (preferably two half shells) are secured onto and about the body of the marker 11. It is envisioned that the two half shells 31A, 31B can be retained together by any means possible. For example, it is possible to retain the shells together by a fastener, such as a screw 32 and retained nut arrangement. FIG. 4 shows male threaded screws 32 routed through pass through holes 35 on one shell 31A and into female threaded holes 33 on the other shell 31. Other possible ways to retain the shells together could be cable ties, clips, ratchets and any other structure envisioned including any of those envisioned by a person of ordinary skill in the art.

FIGS. 4-6 show the contact points between an underlying paintball marker 11 and the shells 31A and 31B, particularly as in FIG. 5 when fully assembled. The contact points are between the protrusions 60 on the shells, as in FIG. 5, and seats (or surfaces) 62, as in FIG. 6, on the marker 11 itself. The communication between the contact points 60 into and onto seats (or surfaces) 62 help key and align a given shell, 31A, 31B to the marker 11. It should be understood that the communication and keying of the shells 31A, 31B to the marker 11 is just one example. The communication can be reversed where the protrusions are on the marker 11 and the recessed seats are on the shells 31A, 31B. Any other complementary contact surface mate between a marker 11 and the shells 31A, 31B can be employed and still be within the scope of the present invention.

These contact points are an integral part of the attachment method around the body giving the clamping sections stability when the mating pads or protrusions 60 on the inner surface of the shell 31A, 31B, as in FIG. 5, are inserted into or onto the notches or seats (or surfaces) 62 and put under tension. This tension is caused by the pads or protrusions (that can be solid or made from a soft foam or rubber material) 60 that push on the upper section of the marker body (FIG. 5). Although these figures show one arrangement of protrusions and notches, there is scope for many contact points or indeed for the whole surface to be a contact point, a wide variety of arrangements are possible and are considered to be covered by this invention.

Although the conversion kit 10 is shown as including two shells in the figures, the conversion kit could also be formed of a single shell. For example, a shell could be formed as a single piece that is capable of being placed around a marker. A flexible portion or a hinged portion on the single shell would allow a single shell to completely enshroud the marker 11. Another example of a single shell would be a shell that provides an upper shroud for a marker and has an aperture in the lower surface of the shell for receiving a marker. Single shell embodiments such as these would allow the user to more quickly convert the marker to a MILSIM type marker, and also provide a conversion kit that more closely simulates a real firearm.

Figure 7:
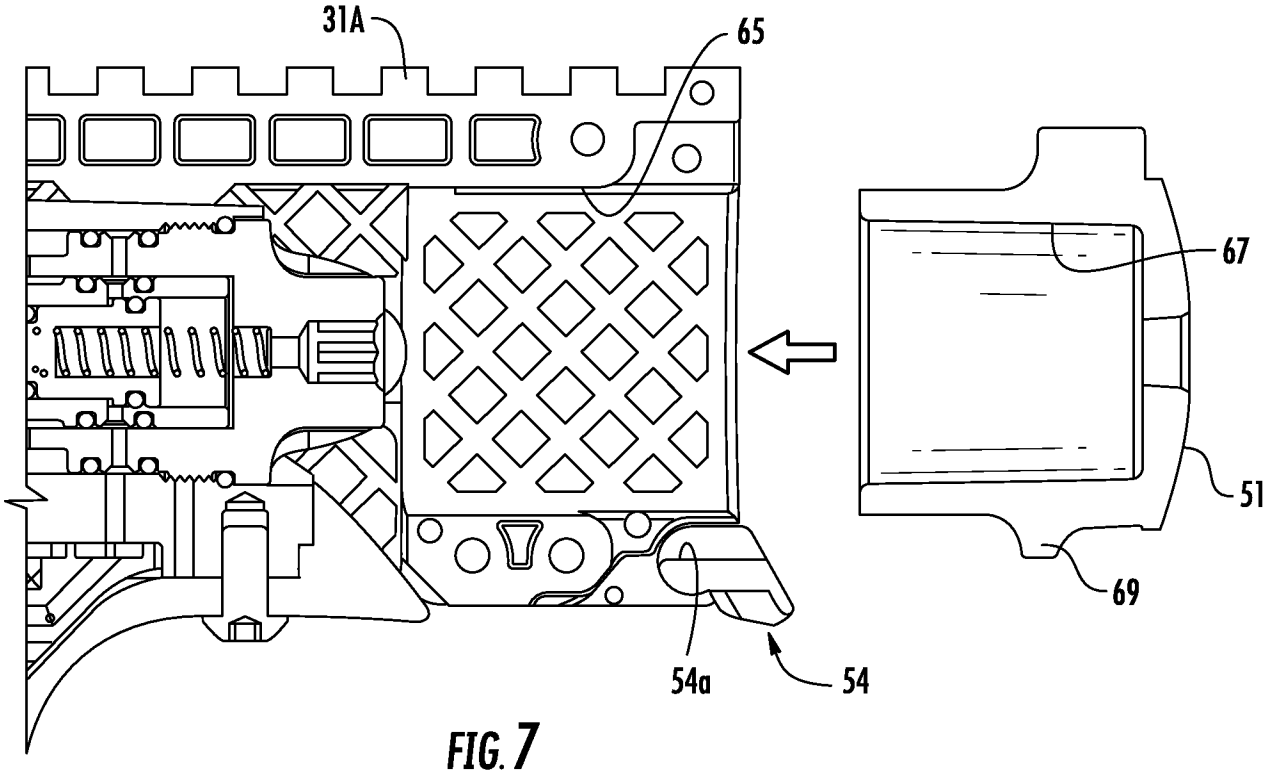
FIGS. 7-10 show the process of installing a blanking plug in the rear of the rail kit of the present invention as retained by a lever lock latching system, one of the shells being removed for illustration purposes.
Figure 8:
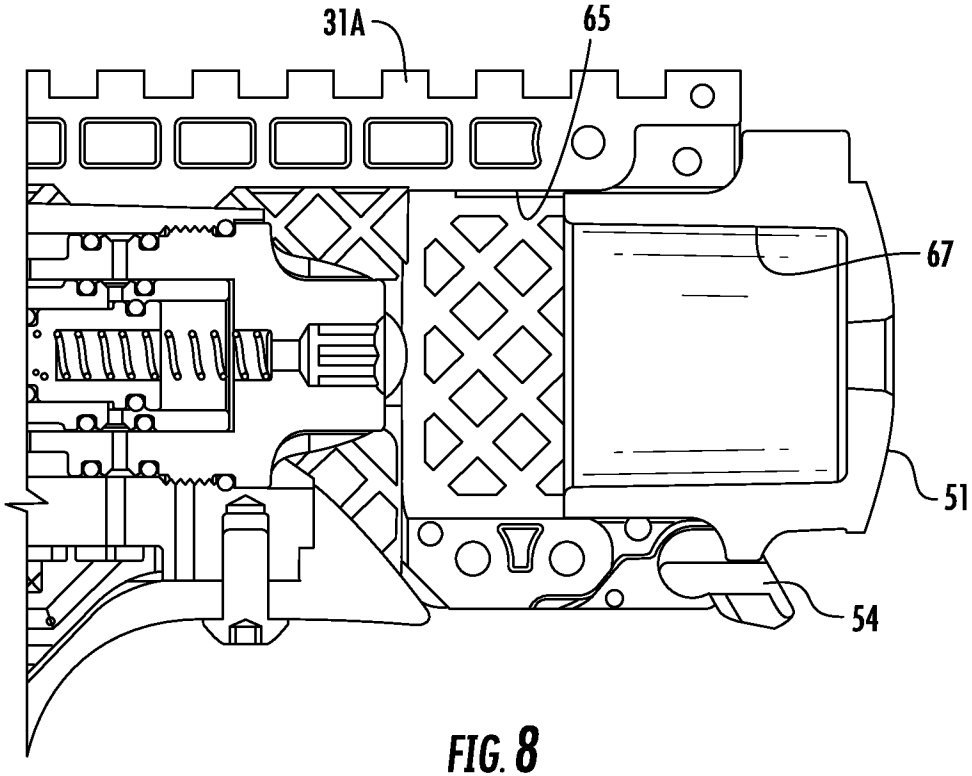
Figure 9:
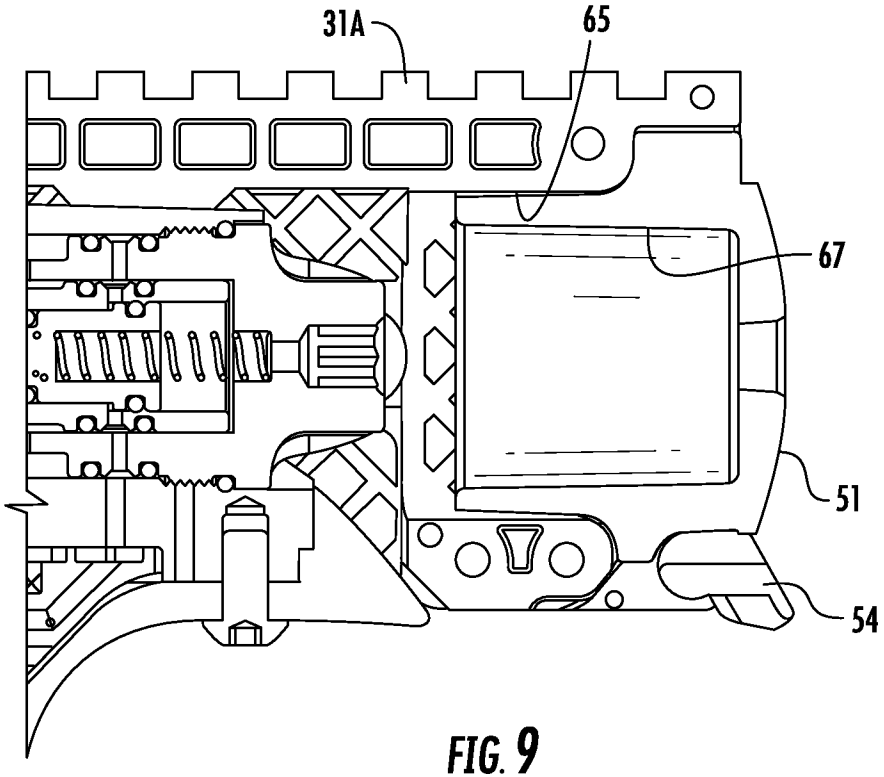

When the two shells 31A, 31B are mated together and enshrouding the marker 11, they leave a rear open end 65. This open end 65 can be either closed up or have an accessory mounted therein. A unique lever latch system, employing a locking latch lever 54 preferably pivotally mounted to one or both of the shells 31A, 31B, as seen in FIGS. 7-11, is integral to the rear open end of the conversion kit 10. More specifically, a blanking plug 51 (FIGS. 7-10) is receivable into the rear open end 65. In FIG. 7, where shell 31B is not shown for illustration purposes, it can be seen that open end 65 is rearwardly facing. Plug 51 is configured to be complementary in shape to the open end. The plug 51 is directed into the rear open end 65, as shown by the arrow. During which time, lever 54 is set in an open position, as seen in FIG. 7. This permits the plug 51 to be easily routed into the rear open end 65. More specifically, tab 69 of plug 51 can easily pass over notch **54*a* of lever 54. In FIG. 8, the plug 51 is shown partially installed into the rear open end 65 with FIG. 9 showing the plug 51 fully installed. It should be noted that its is possible that the plug is not solid but open inside to define opening 67 to permit optional actuation of components of the marker 11**, such as a firing pin, bolt or the like (not shown).

Figure 10:
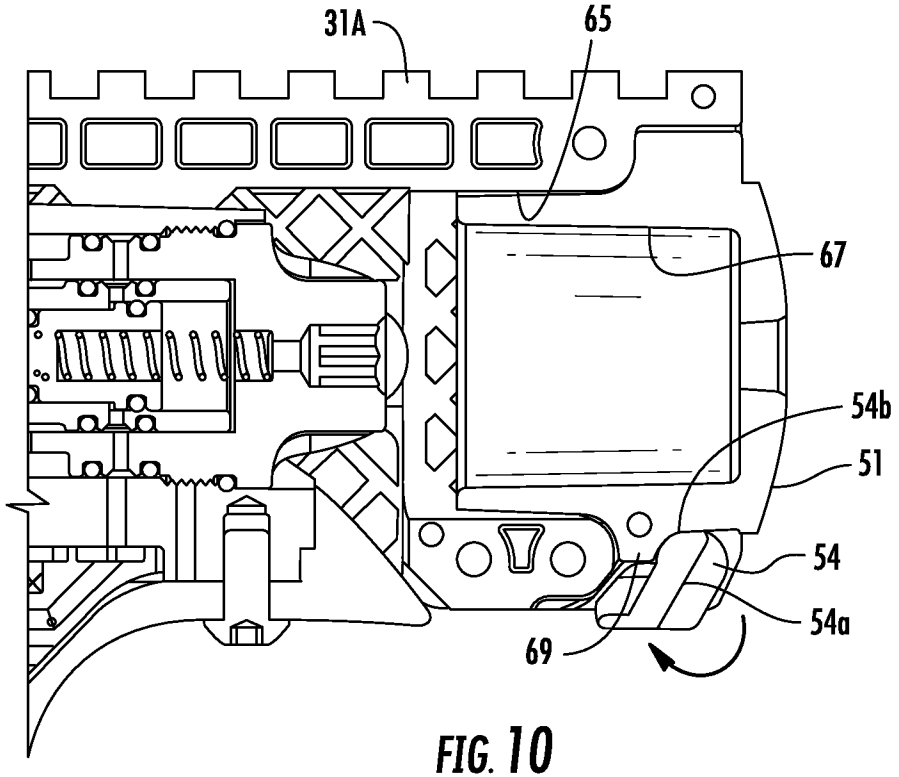

FIG. 10 shows the plug 51 fully installed and seated in place in the rear open end 65 with the lever 54 rotated clockwise in the direction of the arrow shown to locate stop portion **54*a* of the lever 54 directed behind tab 69. As a result, plug 51 is secured in place and is prevented from moving rearward out from the rear open end 65**.

Figure 11:
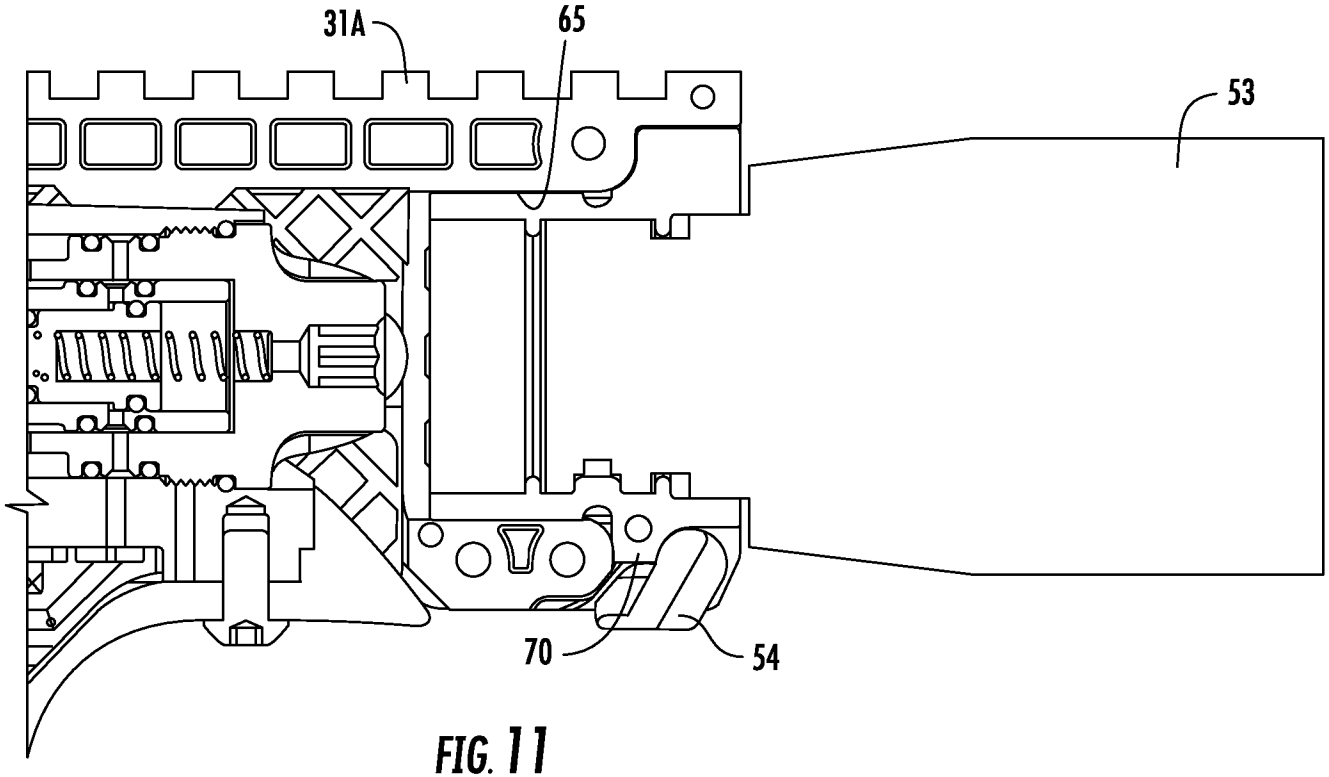
FIG. 11 shows a butt stock, as in FIG. 2, installed in place and retained by the lever lock latching system, one of the shells being removed for illustration purposes.

Turning now to FIG. 11, as an alternative and as another example of an accessory that can be installed in the rear open end 65, a butt stock 53 is shown installed. Such installation still allows the simple quick access to the internals of the paintball marker without removing the whole rail kit 10. The butt stock includes a forward portion this is received in the rear open end 65 in similar fashion to the forward portion of the plug 51. Similarly, a tab 70 is provided on the butt stock 53 to engage with lever 54. Once the butt stock is installed and residing the open end 65, the lever latch 54 is rotated to lock the butt stock 53 in place, as seen in FIG. 11. Further figures are not included herein to show the butt stock 53 unlocked because it is, essentially, the same as how the plug 51 is shown unlocked in FIGS. 7-9.

Although the invention is shown as having a lever 54 to secure the accessories inserted into the rear of the conversion kit 10, the conversion kit 10 could use other retention devices. For example, a user could secure a blanking plug 51 or butt stock 53 in the rear of the conversion kit 10 using cable ties, clips, ratchets, screw thread, bayonet fitting and any other structure envisioned including any of those envisioned by a person of ordinary skill in the art.

In view of the foregoing, a new and novel rail kit system and conversion kit 10 is provided that can easily convert a standard paintball marker or air soft gun 11 from a speedball non-MILSIM setup with no rail system to a scenario MILSIM type setup where a rail kit 31A, 31B fully enshrouds the marker or gun 11 to better simulate a real MILSIM firearm and provide a rail system 38 for receipt of accessories thereon.

The rail kit 10 of the present invention may be made out of any suitable material and manufactured in many different ways. For example, the rail kit 10 may be molded out of plastic or machined from metal, such as aluminum. Any such material and method of manufacture is considered within the scope of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A conversion kit for a projectile launching device having an outer configuration, the projectile launching device having a barrel, the projectile launching device having a projectile receiver that is connected to the barrel and that is capable of being connected to a projectile hopper, the conversion kit comprising:

at least one shell which is capable of being secured on a projectile launching device;

each shell further comprising an inner surface, and at least one first mating surface on the inner surface; each mating surface being capable of being held in tension against a corresponding second mating surface on an outer surface of a projectile launching device to increase stability of the at least one shell when mounted on a projectile launching device;

the at least one shell being configured and arranged to define a pass-through aperture to permit the projectile receiver of the projectile launching device to extend outwardly beyond the at least one shell while the at least one shell is mounted on the projectile launching device, an entry port of the projectile receiver being outside the at least one shell to enable engagement with a projectile hopper for the supply of projectiles to the projectile launching device while the at least one shell is mounted on the projectile launching device;

whereby the at least one shell changes the outer configuration of a projectile launching device onto which it is secured;

whereby the operation of the at least one shell is configured so that it does not affect the operation of the projectile launching device;

wherein the at least one shell is configured so that it does not interfere with the barrel of the projectile launching device while the at least one shell enshrouds the projectile launching device; and wherein the barrel is removable from the projectile launching device without removing the at least one shell from the projectile launching device.

2. The conversion kit of claim 1, wherein the at least one shell is two shells mated together.

3. The conversion kit of claim 1, wherein the at least one shell is two or more shells being capable of being secured about a projectile launching device using fasteners that secure the two or more shells directly to each other, so the shells are capable of being held in tension against the projectile launching device.

4. The conversion kit of claim 3, wherein the fasteners are selected from the group consisting of: threaded fasteners, cable ties, clips, and ratchets.

5. The conversion kit of claim 1, wherein the at least one shell is capable of substantially fully enshrouding a projectile launching device.

6. The conversion kit of claim 1, wherein the at least one shell is capable of converting a non-MILSIM type projectile launching device into a MILSIM type projectile launching device.

7. The conversion kit of claim 2, wherein each shell has an outer surface, and the outer surfaces of the plurality of shells together form a rail system for mounting objects thereto.

8. The conversion kit of claim 1, wherein the at least one shell defining a front end and a rear open end, further comprising:

a blanking plug configured and arranged to reside in the rear open end.

9. The conversion kit of claim 8, further comprising:

a retention device on the at least one shell to secure the blanking plug in the rear open end.

10. The conversion kit of claim 9, wherein the retention device is a latch connected to the at least one shell; the latch being capable of engaging with the blanking plug to prevent its removal from the rear open end.

11. The conversion kit of claim 1 wherein the at least one shell defining a rear open end, further comprising:

a butt stock capable of being inserted into the rear open end; the butt stock being configured to be releasably secured in the rear open end.

12. The conversion kit of claim 11, further comprising:

a retention device on the at least one shell to secure the butt stock in the rear open end.

13. The conversion kit of claim 12, wherein the retention device is a latch connected to the at least one shell; the latch being capable of engaging with the butt stock to prevent its removal from the rear open end.

14. A convertible projectile launching device having an outer configuration, comprising:

a projectile launching device, the projectile launching device having a barrel, the projectile launching device having a projectile receiver that is connected to the barrel and that is capable of being connected to a projectile hopper;

wherein the projectile launching device has an outer surface; the outer surface having at least one mating surface thereon;

at least one shell which is capable of being secured about the projectile launching device;

each shell further comprising an inner surface, and at least one first mating surface on the inner surface; each mating surface being capable of being held in tension against a corresponding second mating surface on an outer surface of a projectile launching device to increase stability of the at least one shell when mounted on a projectile launching device;

the at least one shell being configured and arranged to define a pass-through aperture to permit the projectile receiver of the projectile launching device to extend outwardly beyond the at least one shell while the at least one shell is mounted on the projectile launching device, an entry port of the projectile receiver being outside the at least one shell to enable engagement with a projectile hopper for the supply of projectiles to the projectile launching device while the at least one shell is mounted on the projectile launching device;

whereby the at least one shell changes the outer configuration of a projectile launching device on which it is secured;

whereby the operation of the at least one shell is configured so that it does not affect the operation of the projectile launching device;

wherein the at least one shell is configured so that it does not interfere with the barrel of the projectile launching device while the at least one shell enshrouds the projectile launching device; and wherein the barrel is removable from the projectile launching device without removing the at least one shell from the projectile launching device.

15. The projectile launching device of claim 14, wherein the at least one shell is two shells mated together.

16. The convertible projectile launching device of claim 14, wherein the at least one shell is two or more shells being capable of being secured about the projectile launching device using fasteners that secure the two or more shells directly to each other, so the shells are capable of being held in tension against the projectile launching device.

17. The convertible projectile launching device of claim 16, wherein the fasteners are selected from the group consisting of: threaded fasteners, cable ties, clips, and ratchets.

18. The convertible projectile launching device of claim 14, wherein the at least one shell is capable of substantially fully enshrouding the projectile launching device.

19. The convertible projectile launching device of claim 14, wherein the projectile launching device is selected from the group consisting of a paintball marker and an airsoft gun; and wherein the at least one shell is capable of converting the projectile launching device to a MILSIM type projectile launching device.

20. The convertible projectile launching device of claim 15, wherein each shell has an outer surface, such that the outer surfaces of the plurality of shells together define a rail system for mounting objects thereto.

21. The convertible projectile launching device of claim 14, wherein the at least one shell defining a front end and a rear open end, further comprising:

a blanking plug configured and arranged to reside in the rear open end.

22. The convertible projectile launching device of claim 21, further comprising:

a retention device on the at least one shell to secure the blanking plug in the rear open end.

23. The convertible projectile launching device of claim 22, wherein the retention device is a latch connected to the at least one shell; the latch being capable of engaging with the blanking plug to prevent its removal from the rear open end.

24. The convertible projectile launching device of claim 14 wherein the at least one shell defines a rear open end, further comprising:

a butt stock capable of being inserted into the rear open end; the butt stock being configured to be releasably secured in the rear open end.

25. The convertible projectile launching device of claim 24 wherein the at least one shell defines a rear open end, further comprising:

a retention device on the at least one shell to secure the butt stock in the rear open end.

26. The convertible projectile launching device of claim 25, wherein the at least one shell defines a rear open end; and wherein the retention device is a latch connected to the at least one shell; the latch being capable of engaging with the butt stock to prevent its removal from the rear open end.

27. The conversion kit of claim 1, wherein each first mating surface is selected from one of: a protrusion and a seat; and each respective second mating surface is selected from the other of: a protrusion and a seat; and wherein the at least one first mating surface on the inner surface is configured for keying and aligning the at least one shell on a projectile launching device.

28. The conversion kit of claim 1, wherein the conversion kit is for a projectile launching device having a gas tube receiver for receiving compressed gas from a compressed gas tank;

wherein the at least one shell is capable of enshrouding the projectile launching device while allowing access to a gas tube receiver of the underlying projectile launching device.

29. The conversion kit of claim 1, further comprising:

an aperture defined in the at least one shell, and a removable eye cover plate received in the respective aperture, the respective removable eye cover plate and the respective aperture allowing access to a projectile detector on the projectile launching device.

30. The conversion kit of claim 1, wherein the conversion kit is for a projectile launching device having a projectile receiver on an upper surface of the projectile launching device;

wherein the at least one shell is configured so that the projectile receiver extends upwardly beyond the at least one shell of the conversion kit while the at least one shell is mounted on the projectile launching device.

31. A conversion kit for a projectile launching device having an outer configuration, the projectile launching device having a barrel, the projectile launching device having a projectile receiver that is connected to the barrel and that is capable of being connected to a projectile hopper, the conversion kit comprising:

at least one shell which is capable of being secured on a projectile launching device;

each shell further comprising an inner surface, and at least one first mating surface on the inner surface; each mating surface being capable of being held in tension against a corresponding second mating surface on an outer surface of a projectile launching device to increase stability of the at least one shell when mounted on a projectile launching device;

an aperture defined in the at least one shell, and a removable eye cover plate received in the respective aperture, the respective removable eye cover plate and the respective aperture allowing access to a projectile detector on the projectile launching device;

the at least one shell being configured and arranged to define a pass-through aperture to permit the projectile receiver of the projectile launching device to extend outwardly beyond the at least one shell while the at least one shell is mounted on the projectile launching device, an entry port of the projectile receiver being outside the at least one shell to enable engagement with a projectile hopper for the supply of projectiles to the projectile launching device while the at least one shell is mounted on the projectile launching device;

whereby the at least one shell changes the outer configuration of a projectile launching device onto which it is secured; and whereby the operation of the at least one shell is configured so that it does not affect the operation of the projectile launching device.

32. The conversion kit of claim 31, wherein the at least one shell is two shells mated together.

33. The conversion kit of claim 31, wherein the at least one shell is two or more shells being capable of being secured about a projectile launching device using fasteners that secure the two or more shells directly to each other, so the shells are capable of being held in tension against the projectile launching device.

34. The conversion kit of claim 33, wherein the fasteners are selected from the group consisting of: threaded fasteners, cable ties, clips, and ratchets.

35. The conversion kit of claim 31, wherein the at least one shell is capable of substantially fully enshrouding a projectile launching device.

36. The conversion kit of claim 31, wherein the at least one shell is capable of converting a non-MILSIM type projectile launching device into a MILSIM type projectile launching device.

37. The conversion kit of claim 32, wherein each shell has an outer surface, and the outer surfaces of the plurality of shells together form a rail system for mounting objects thereto.

38. The conversion kit of claim 31, wherein the at least one shell defining a front end and a rear open end, further comprising:

a blanking plug configured and arranged to reside in the rear open end.

39. The conversion kit of claim 38, further comprising:

a retention device on the at least one shell to secure the blanking plug in the rear open end.

40. The conversion kit of claim 39, wherein the retention device is a latch connected to the at least one shell; the latch being capable of engaging with the blanking plug to prevent its removal from the rear open end.

41. The conversion kit of claim 31 wherein the at least one shell defining a rear open end, further comprising:

a butt stock capable of being inserted into the rear open end; the butt stock being configured to be releasably secured in the rear open end.

42. The conversion kit of claim 41, further comprising:

a retention device on the at least one shell to secure the butt stock in the rear open end.

43. The conversion kit of claim 42, wherein the retention device is a latch connected to the at least one shell; the latch being capable of engaging with the butt stock to prevent its removal from the rear open end.

* * * * *